US005850198A

United States Patent [19]

Lindenmeier et al.

[11] Patent Number: 5,850,198

[45] Date of Patent: Dec. 15, 1998

[54] FLAT ANTENNA WITH LOW OVERALL HEIGHT

[75] Inventors: Heinz Lindenmeier, Planegg; Jochen Hopf, Haar; Leopold Reiter, Gilching, all of Germany

[73] Assignee: FUBA Automotive GmbH, Bad Salzdetfurth, Germany

[21] Appl. No.: 718,536

[22] PCT Filed: Mar. 19, 1996

[86] PCT No.: PCT/DE96/00472

§ 371 Date: Sep. 30, 1996

§ 102(e) Date: Sep. 30, 1996

[87] PCT Pub. No.: WO96/29757

PCT Pub. Date: Sep. 26, 1996

[30] Foreign Application Priority Data

Mar. 21, 1995 [DE] Germany ..... 195 10 236.3

[51] Int. Cl.[6] ..... H01Q 1/32; H01Q 13/10

[52] U.S. Cl. ..... 343/713; 343/767; 343/848

[58] Field of Search ..... 343/700 MS, 713, 343/767, 770, 848, 702

[56] References Cited

U.S. PATENT DOCUMENTS

| | | | |
|---|---|---|---|
| 4,125,837 | 11/1978 | Kaloi | 343/700 MS |
| 4,191,959 | 3/1980 | Kerr | 343/700 MS |
| 4,641,366 | 2/1987 | Yokoyama et al. | 455/89 |
| 4,692,769 | 9/1987 | Gegan | 343/700 MS |
| 4,835,541 | 5/1989 | Johnson et al. | 343/713 |
| 5,355,142 | 10/1994 | Marshall et al. | 343/700 MS |
| 5,526,003 | 6/1996 | Ogawa et al. | 343/700 MS |
| 5,532,707 | 7/1996 | Klinger et al. | 343/793 |
| 5,627,550 | 5/1997 | Sanad | 343/700 MS |

FOREIGN PATENT DOCUMENTS

| | | |
|---|---|---|
| 0 163 454(A2) | 12/1985 | European Pat. Off. . |
| 0 163 454(B1) | 12/1985 | European Pat. Off. . |
| 0 176 311 | 4/1986 | European Pat. Off. . |
| 0 177 362 | 4/1986 | European Pat. Off. . |
| 0 226 390 | 6/1987 | European Pat. Off. . |
| 21 53 827 | 8/1972 | Germany . |
| 26 33 757 | 4/1977 | Germany . |

*Primary Examiner*—Hoanganh T. Le
*Assistant Examiner*—Tan Ho
*Attorney, Agent, or Firm*—Collard & Roe, P.C.

[57] ABSTRACT

The invention relates to an antenna with electrically low overall height, preferably for frequencies in the GHz-range. It consists of a first electrically conductive area (1) which, in the first frequency range, is not larger in any dimension than ⅜ lambda, and a second eletrically conductive area (2) of at least the same size acting as the electrical counterweight, said second area being substantially parallel with the first conductive area (1) and arranged opposite the latter with a certain spacing (A) from the latter, and of a conductive bridge (4) connecting an edge (5) of the first conductive area (1) across a width (B) to the second electrically conductive area (2) in a low-ohmic way in terms of high frequency, whereby the first electrically conductive area (1) is electrically conductively connected in an antenna connection site in a coupling point (3) to the inside conductor of a coaxial line (7) conducting high frequency via a conductor (15), and the dimensions of the antenna and the coupling point (3) are selected in a way such that the antenna is in resonance in the first frequency range. For the formation of resonance, slots (10) having a suitable slot width (9) and shape are formed in at least one additional frequency range at least in one of the two conductive areas or/and in the conductive bridge.

16 Claims, 7 Drawing Sheets

FLAT ANTENNA WITH LOW OVERALL HEIGHT

BACKGROUND OF THE INVENTION

1. Field of the Invention

The invention relates to an antenna of the type specified in the introductory part of claim 1. An antenna of said type can be very advantageously used in the radio operation on motor vehicles for mobile radio services. Especially in the GHz-frequency range, it has the advantage of combining a low overall height with the desired directional diagram.

2. Prior Art

The invention is based on antennas of said type, as they are known from D-AS 2153 827 and D-AS 2633 757, as well as from the European patent applications EP 0176311, EP 0177362, and EP 0163454. The antennas described therein are substantially designed with an L-shaped, flat part above a conductive base surface, or as U-shaped flat antennas.

The operating principle of said antennas consists in that the have a resonance at the operating frequency, whereby the resonance is characterized by an equalized blind power balance between the magnetic blind power and the capacitive blind power, so that a substantially real or not excessively reactive impedance prevails at the intended antenna connection point. Said resonance effect is described in the substitute circuit diagram, FIG. 4 of EP 0177362 for an L-shaped antenna. With resonance of the L-structure, the blind powers of the magnetic fields forming the strong currents on and within the proximity of bridge 38 in FIG. 3 are equalized with the capacitive blind power forming the electrical fields between the surface 36 and the base plate 39.

SUMMARY OF THE INVENTION

All antennas of said type are, according to the present state of the art, monofrequent antennas, i.e., they are operated at their basic resonance frequency, which physically is a precondition for the fact that the directional diagram substantially has a round characteristic in connection with a structure above a conductive surface. However, particularly when used as a mobile radio antenna on board of motor vehicles, antennas are desired that can be used at the same time in a number of frequency ranges. An important example is the use of a mobile radio antenna both in the D-mobile radio network and in the frequency range of the E-mobile radio network at about twice the frequency (1.8 GHz). In addition, the simultaneous use of an antenna in the frequency-adjacent GPS-navigation radio service is often desired.

Therefore, the problem of the invention is to make available in connection with an antenna according to the introductory part of claim 1 the function of several frequency ranges with the help of measures that can be implemented in a simple way. Such measures are to permit a manufacture at costs as favorable as possible.

According to the invention, said problem is solved by an antenna with the features in the characterizing part of claim 1.

Exemplified embodiments of the subject matter of the invention are described in the following by reference to the drawings, in which:

DESCRIPTION OF THE PREFERRED EMBODIMENT

The basic operating principle of the antenna according to the invention is based on obtaining with the help of the inherent resonance of slots and recesses on the conductive surfaces of the antenna in each case one antenna resonance in different frequency ranges. In the simplest way, this can be effected in that the slots 10 in the first frequency range have only little influence on the current distribution on the antenna, and that due to the inherent resonance of the slot arrangements, the flow of current on the antenna is taking place in a way such that resonance exists in said frequency range with respect to the antenna impedance as well.

Figure 1:
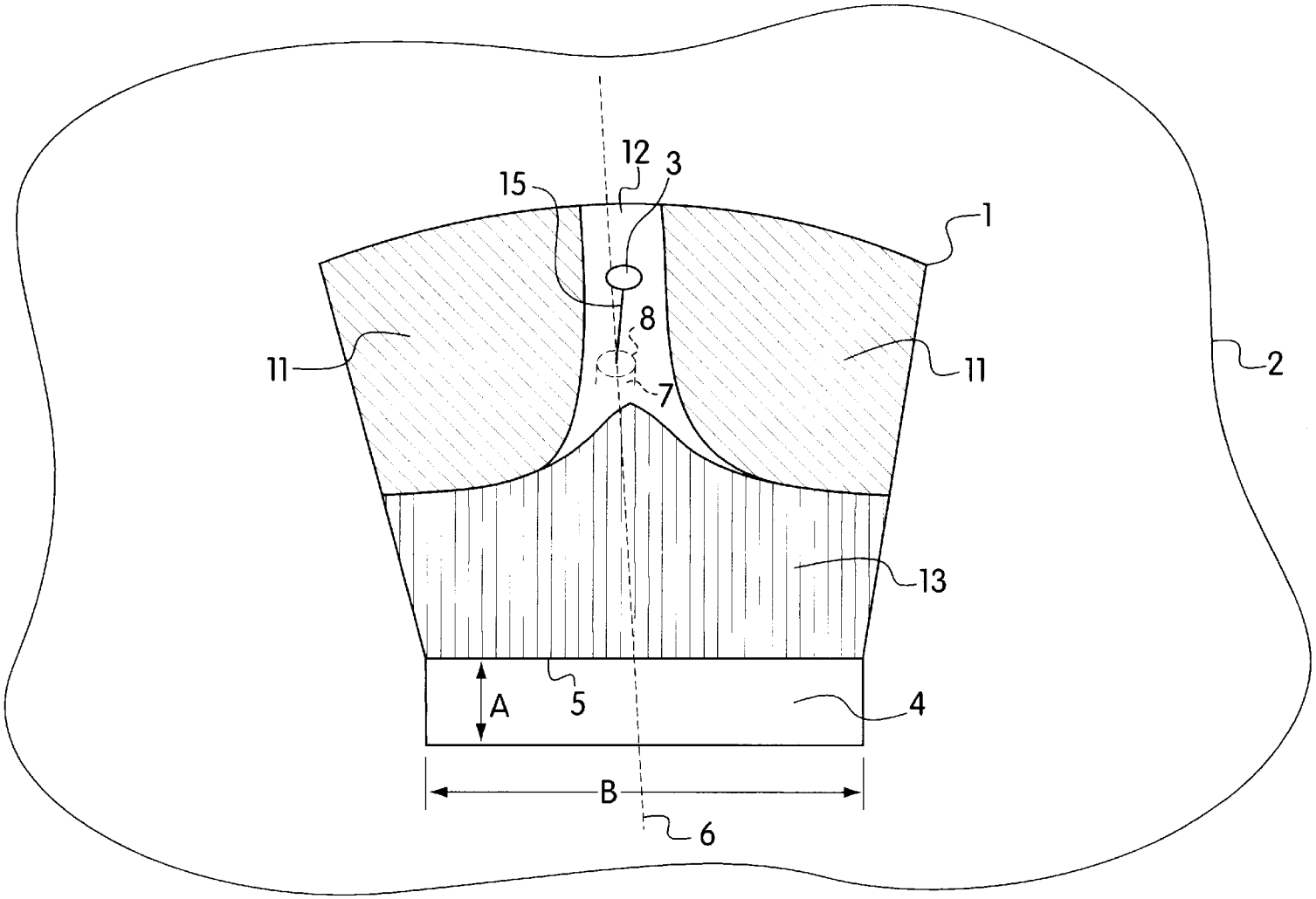
FIG. 1 shows an L-shaped antenna with an almost rectangular first conductive surface above a conductive counterweight, with operating zones in a further higher-frequent frequency range shown shaded: 11=marginal zones with small current; 13=inner zone active for resonance formation; 3=current path between coupling point 3 and conductive bridge 4.

FIG. 1 illustrates the operating principle of the antenna according to the invention. In the first, thus in the lower frequency range, the entire first conductive area 1 acts, and due to the slots 10 according to claim 1, it is impaired in its effect only little, so that the antenna acts in said range like the antennas described according to the state of the art. In order to obtain a desired resonance in another, higher frequency range as well, provision is made for the slots 10 within the proximity of the marginal zones 11 according to the characterizing part of claim 1, which slots suppress particularly the highly active marginal currents in the higher frequency range. Therefore, according to the invention, a current path 12 develops between the connection point 3 and the bridge 4, in which path the antenna currents flow. With a suitable course of the path and suitable dimensioning of the slots 10, the inner zone 13, which is located near the bridge 4, is excited via said current path 12 for generating the resonance. Due to the smallness of the inner zone 13 as compared to the entire first conductive area 1, a higher resonance frequency is obtained in addition to the first resonance frequency for the other frequency range. If the largest dimension of the first conductive area 1 is smaller than ⅜th lambda, the azimuthal round diagram is still largely given, for example even at the double frequency of the low frequency range.

Figure 3:
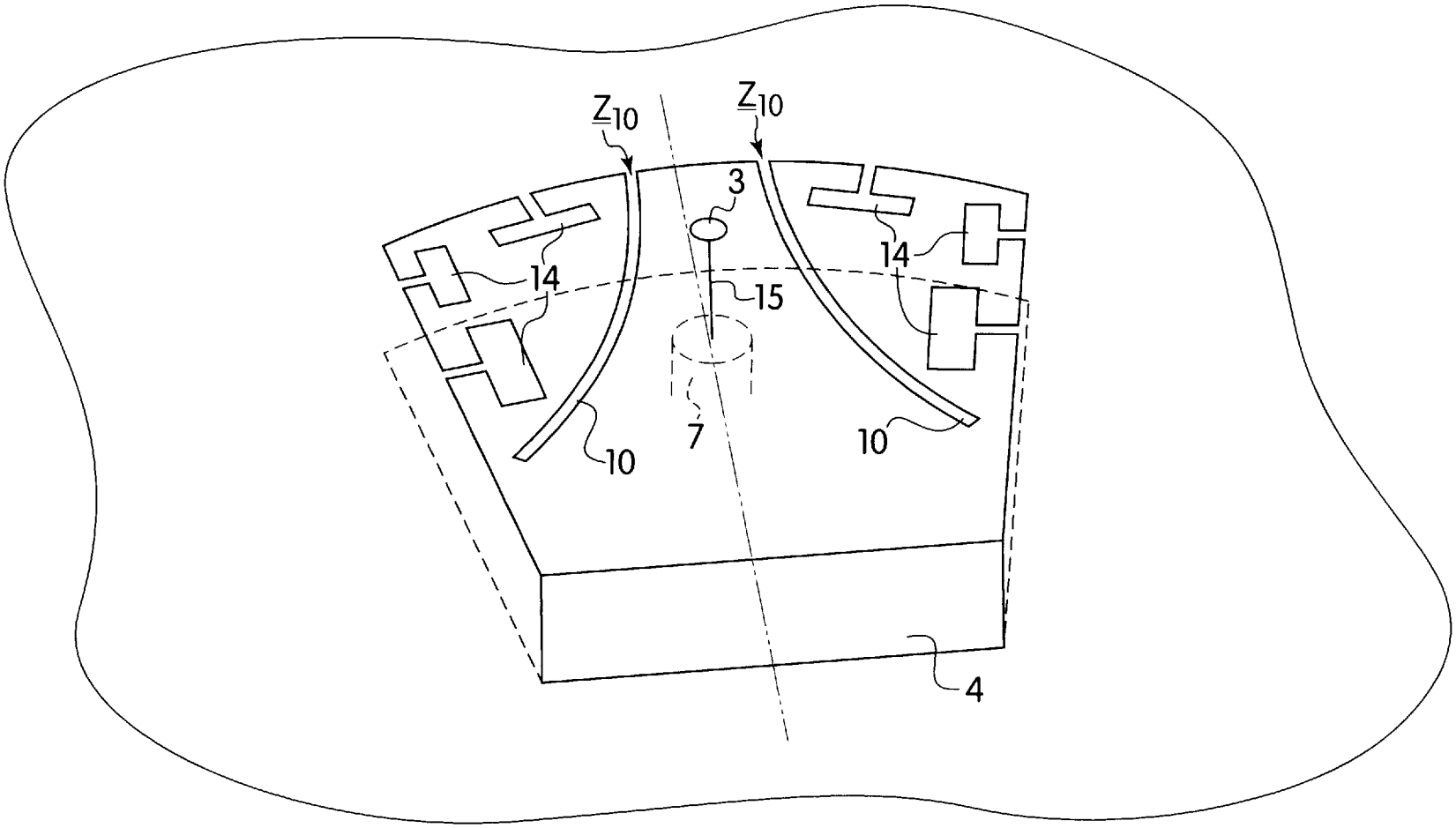
FIG. 3 shown an antenna with a trapezoidal first conductive area above a conductive counterweight and exemplified design of the slots 10, with high input impedance at their open ends for suppressing edge currents in another higher frequency range, and with additional slots as capacitive load at the open ends, whereby the slots are inductively loaded by rectangular cutouts, so that at the open slot end on the margin of the area, a high-impedance blind resistance is adjusted in the other higher frequency range. Dashed: minimum quantity of the second conductive area.
Figure 3A:
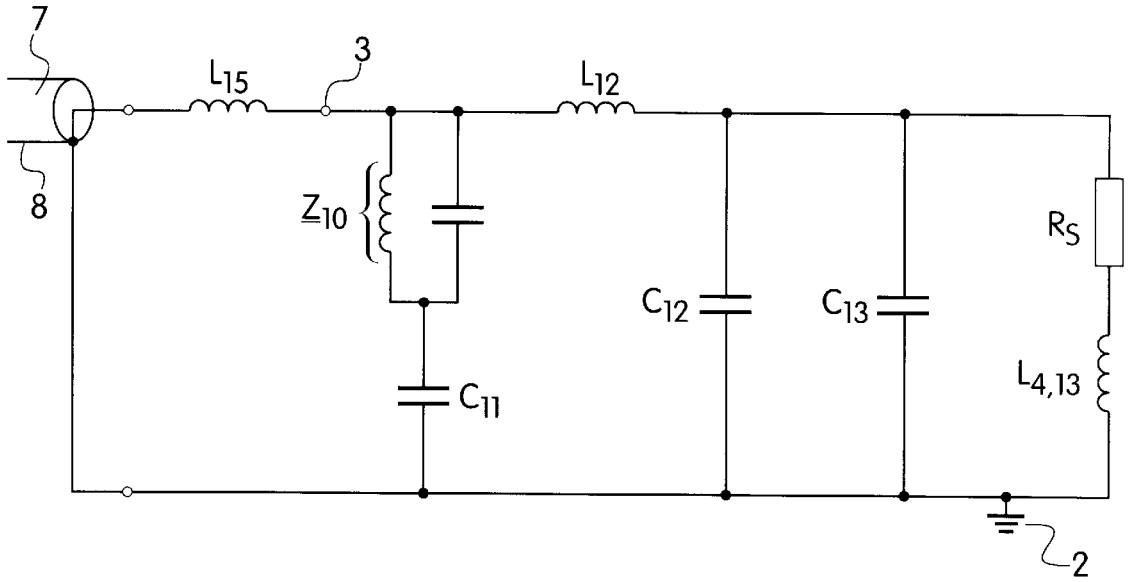
FIG. 3*a* shows a highly simplified substitute circuit diagram of an antenna according to the invention for explaining the operating principle.

In order to explain the operating principle of the antenna in a superior way, the highly simplified substitute circuit diagram of FIG. 3*a* is viewed, which, however, shows the individual operating elements only in a very roughly approximated way. The rough simplification of the representation consists in that blind elements acting in a distributed way are represented for the sake of better understanding as concentrated elements and, therefore, cannot be viewed as frequency-independent. The basic operating mode of the antenna in the higher frequency range nevertheless can be explained on said simplified substitute circuit diagram. If one assigns to the bridge 4, the latter being connected with the base plate, and to the inner zone 13 an inductivity of $L_{4,13}$ with a series radiation resistance $R_s$, and represents the capacity $C_{13}$ as the capacity of the inner zone 13 with the base plate, and the capacity $C_{12}$ as the capacity of the current path 12 with the base plate, and if $L_{12}$ is the series inductivity of said current path, the capacity $C_{11}$ of the two marginal zones 11 with the base plate is connected in parallel with the connection point 3 at the open end of the slots 10 via the high-ohmic input impedance $Z_{10}$ at said frequency. By inserting the slot impedance $Z_{10}$ and its representation as a high-ohmic parallel resonance circuit, it can be seen that the resonance behavior according to the invention is obtained at a number of frequencies. A slot forms in a conductive surface an electric conduction, whose wave resistance rises with the slot width 9. In terms of tendency, the active frequency bandwidth of the slot resonance is, in view of the influence on the antenna currents, the greater the larger the slot width. While at the first, low frequency, the resonance is mainly formed from the sum of the capacities $C_{11}$, $C_{12}$, $C_{13}$, and the inductivity $L_{12}$, $L_{4,13}$, complete shutoff of the relatively high capacity $C_{11}$ results from resonance of the slot line, which means the antenna has a resonance even at the higher frequency. Accordingly, the difference in frequency between the first and the second resonance is the greater the larger the zone 11 has been selected in FIG. 1 by suitable positioning of the slots 10, i.e., the closer the slots neighboring connection point 3 are to each other.

Figure 2:
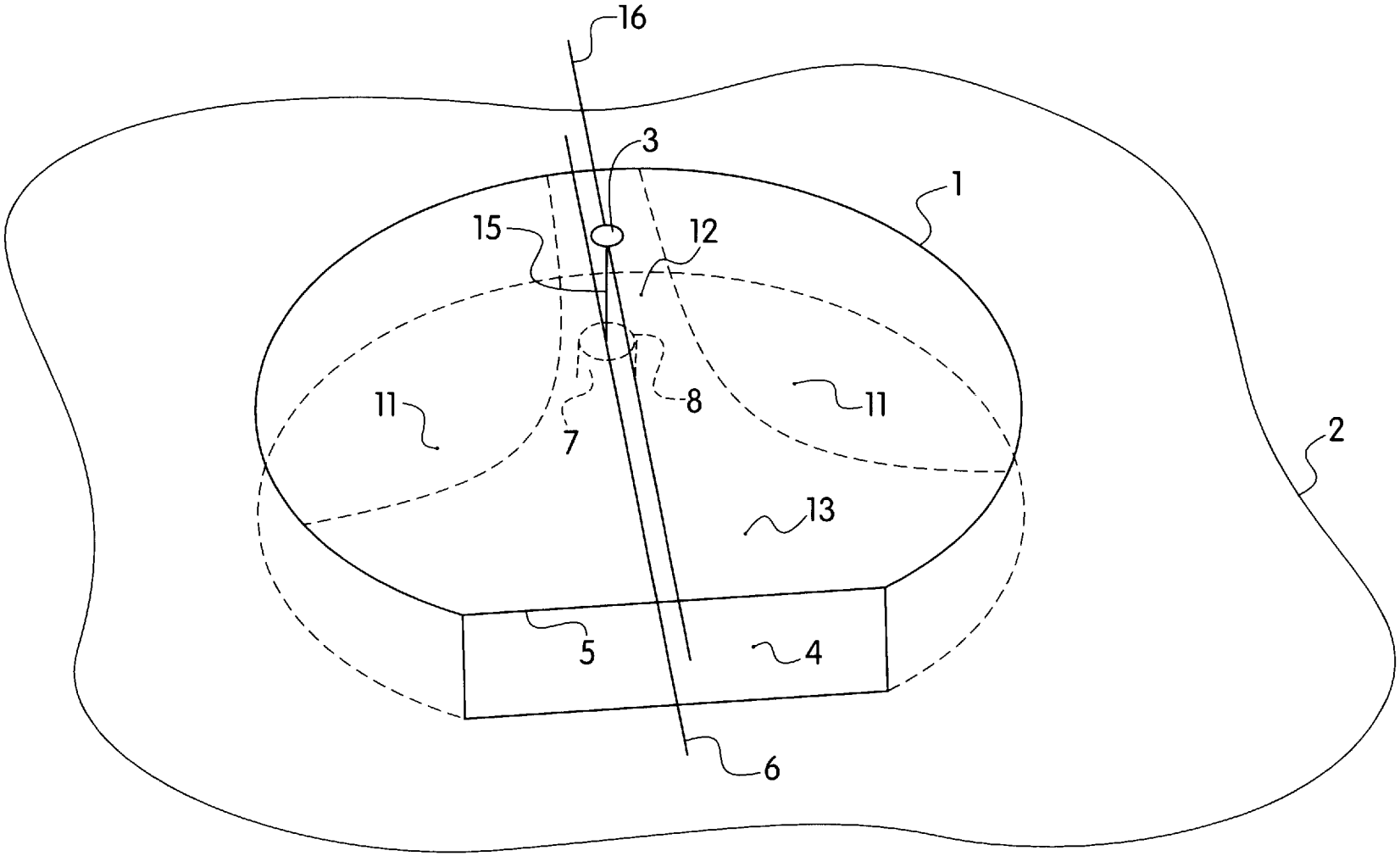
FIG. 2 shows the same antenna as the one in FIG. 1, however, with a nearly circular first conductive area and a circle segment missing.

The shape of the antenna can be freely selected with respect to the basic mode of operation within wide limits. The described effect of the antenna of said type can be obtained if the first conductive area has, for example the form of a rectangle, a trapezoidal shape, the form of a circular sector, or of a circle with a circular segment missing. Also, it is not necessary to mandatorily adhere to a symmetry condition with respect to the areal shape and arrangement of the slots. For the purpose of illustration, the respective active zones are plotted in FIG. 2 for an antenna with a circular form and a missing circular segment.

FIG. 3 shows by way of example an advantageous design of two slots 10 for forming the current path 12 as well as the marginal zones 11, and the inner zone 13 in FIG. 1 acting for the formation of resonance. For forming the current path 12, it is advantageous in this connection to form the slots 10 in their main direction as a margination of the current path. If the slot is long at the higher frequency lambda/4, it has at its open end on the margin of the first area a high input impedance, so that currents are, at said frequency, hindered in their flow from the connection point 3 to the low-current zones 11. At the notably lower frequency, if the latter is, for example, only half as high, the slots do not represent any significant obstacle to the currents. Their action on the resonance frequency in the first frequency range can be included in the known way in the dimensioning of the first conductive area 1. In addition to the slots 10, provision may be made for slots which, at their end opposite the edge of the conductive area 1, are terminated with an inductively acting cutout from the conductive area 1. The margination of said cutout 14, due to its greater length, acts inductively, as opposed to the slot having a highly capacitive effect because of the small slot width. In a suitable embodiment, the blind resistance formed in this connection at the open end of the slot may be designed high-ohmic in the second frequency range, so that marginal currents are substantially suppressed on the first conductive surface 1. The effect of said arrangement is that the zones denoted in FIG. 1 by 11 contribute only little to the capacity of the first conductive area 1, as compared to the electrically conductive area 2 acting as an electrical counterweight. The reduction of the effective capacity thus effects in the second frequency range a resonance, whereby the inner zone 13 (see FIG. 1) acting for the formation of resonance is excited via the current path 12 between the coupling point 3 and the conductive bridge 4 in FIG. 1.

Figure 4:
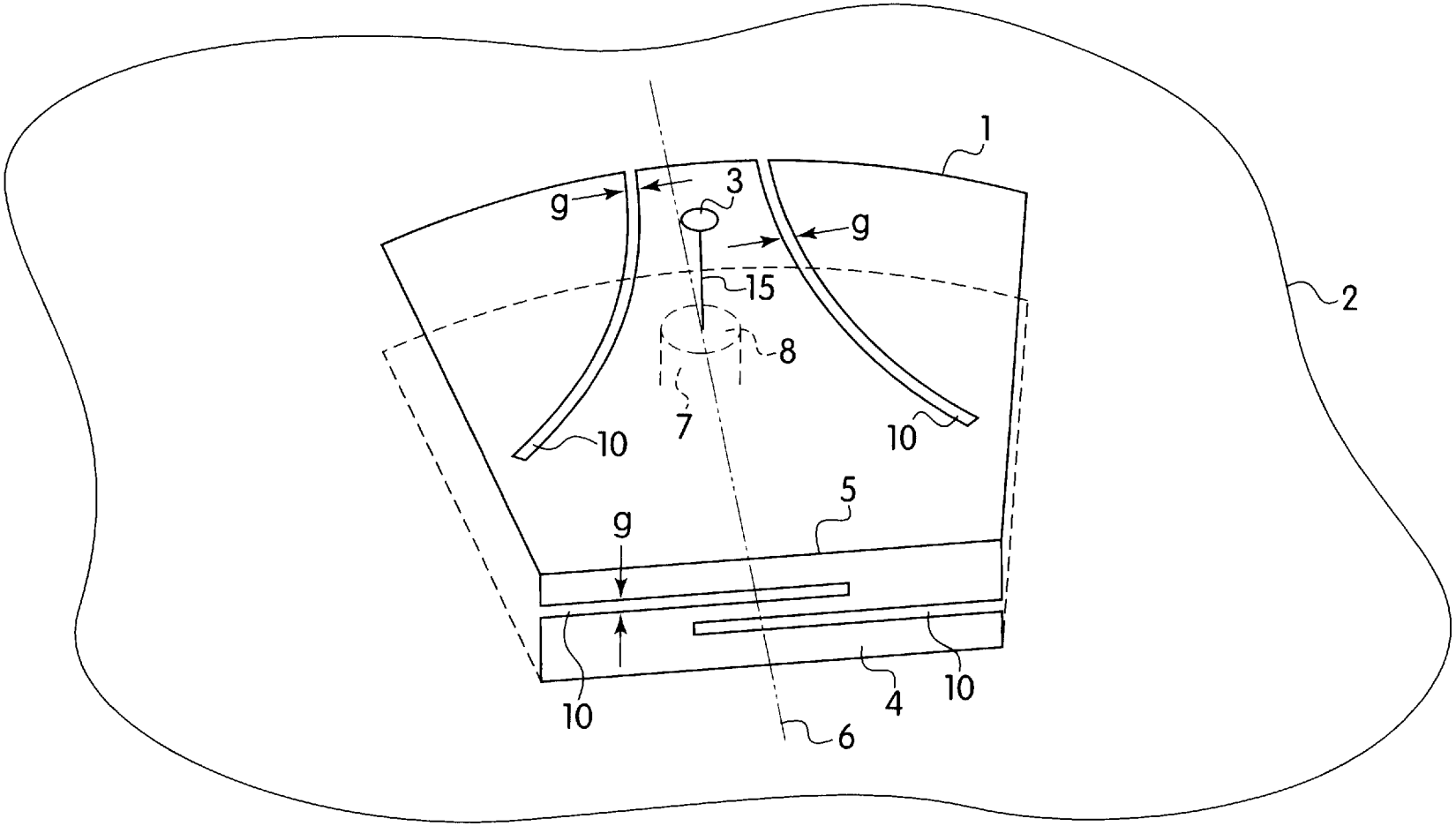
FIG. 4 shows the same antenna as the one of FIG. 3, with the slots 10 in the bridge 4 for tuning the inherent inductivity of the bridge in the various frequency ranges.

The bridge 4 mainly acts inductively. In FIG. 4, the slots 10 are provided in the bridge 4 as well in order to produce in this way with the help of the changed inductivity in a second frequency range—in which the slots have ¼-wavelength resonance at their open ends—the resonance frequency of the antenna in said frequency range as well.

Figure 5:
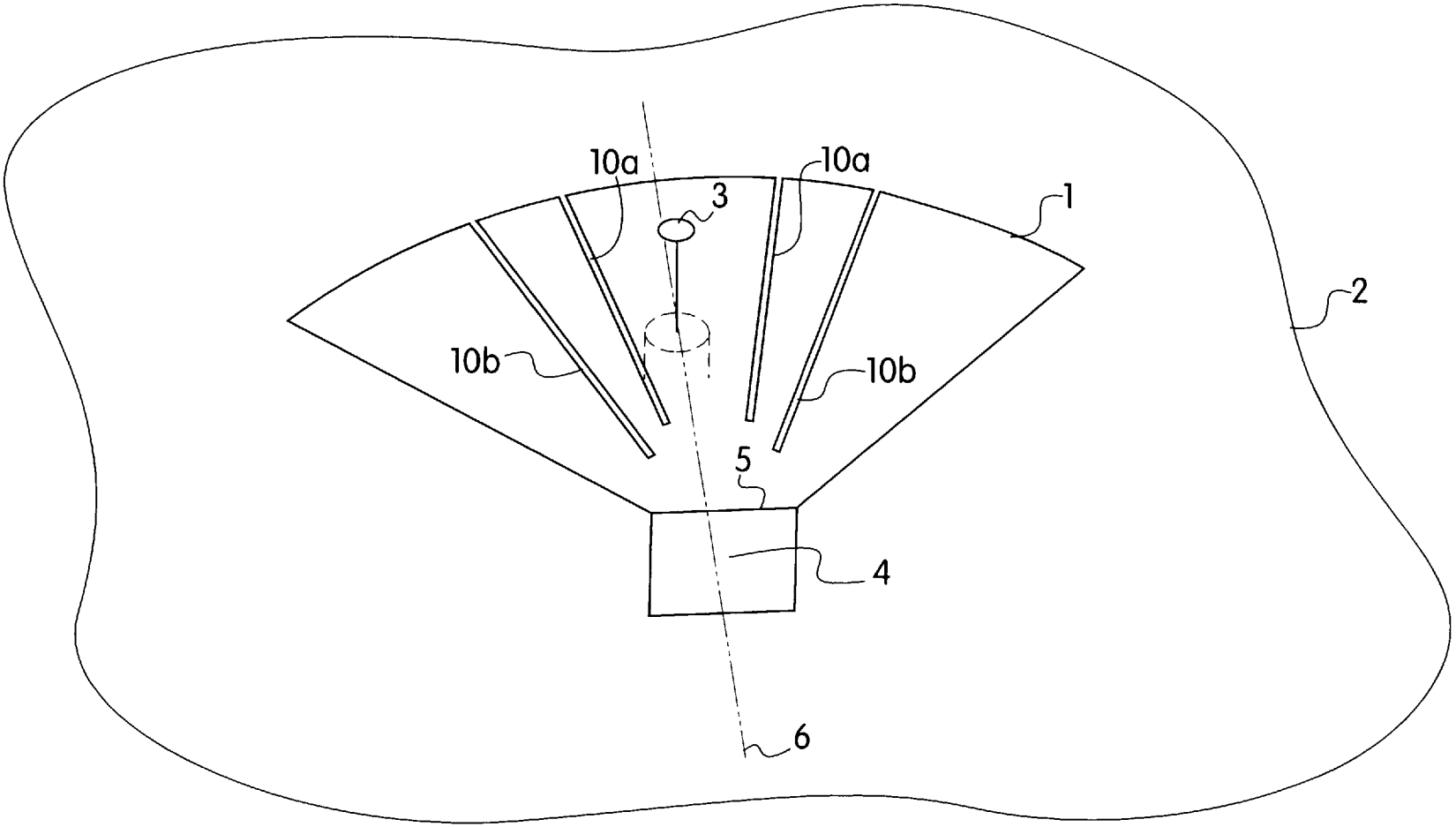
FIG. 5 shows an L-shaped antenna above a conductive base with a circular sector as the first conductive area 1, and nearly quarter-wavelength slots in the other frequency range for suppressing currents in the marginal zone of the first area. The slots of different lengths effect resonances in two higher frequency ranges, the latter being adjacent each other.

FIG. 5 shows a particularly advantageous embodiment of an antenna according to the invention. Here, the first conductive area 1 of the antenna has the form of a circular sector with a missing sector triangle at the tip of the circular sector. The slots 10 are in this exemplified embodiment arranged on large straight-line sector rays, starting from the circular edge of the sector in the direction of the inner zome of the first conductive area 1. Such an antenna can be used very advantageously as an antenna for the D-mobile radio network (about 900 MHz) and the E-mobile radio network (about 1800 MHz). In the present case, about lambda/4 has to be selected for the length of the slots for the frequency range of the E-network; in the higher frequency range, mainly only the inner zone 13 of the first conductive area 1 near the edge 5 and the bridge 4 is acting is this connection. A particularly advantageous embodiment of said antenna covers also the frequency of the global positioning system (GPS). This is accomplished in a simple way in that by using a number of slots with slightly uneven lengths for the slots 10*a* and 10*b* in FIG. 5, resonance of the antenna is obtained at the GPS-frequency (1574 MHz) as well. In a practical embodiment of an antenna according to the invention, the circular sector angle comes to, for example 90 degrees. The slots are arranged symmetrically relative to the bisecting line of the angle. The shorter slots near the center line 6 have, in the present exemplified embodiment, a length of 0.25 lambda for the suppression of currents in the E-network frequency range. A length of 0.23 lambda was selected for the longer slots in FIG. 5 for generating the resonance of the antenna on the GPS-frequency.

Such an antenna has the special advantage that it can be manufactured in a simple way. If it is used above a conductive base plate or a mechanical carrier plate, the first conductive surface 1 and the bridge 4 can be punched from a metal sheet in one working step together with the slots 10*a* and 10*b* with the typically required slot widths of 0.5 to 1.5 mm. By bending the edge 5 at a right angle, the antenna is mounted with the lower edge of the bridge 4 on the counterweight in a simple way. After the alignment of the position of the slots and their dimensions have been found in a way such that resonances of the antenna are generated at all three frequencies, the antenna can be manufactured with the help of a punching tool with great precision and at extraordinarily favorable cost. Furthermore, the selection of the sector angle is relatively free in connection with the antenna according to the invention. It has been found that with a predetermined trapezoidal or rectangular shape for the first conductive area 1 selected according to the state of the art, the slots 10 can always be provided according to the proviso of the present invention in a way such that the problem according to the invention for the generation of multiple resonances can be solved. An antenna according to the invention can be manufactured in a similarly simple way by the printed circuit board technology, whereby it is possible to realize even more complicated slot forms at favorable cost.

Figure 6:
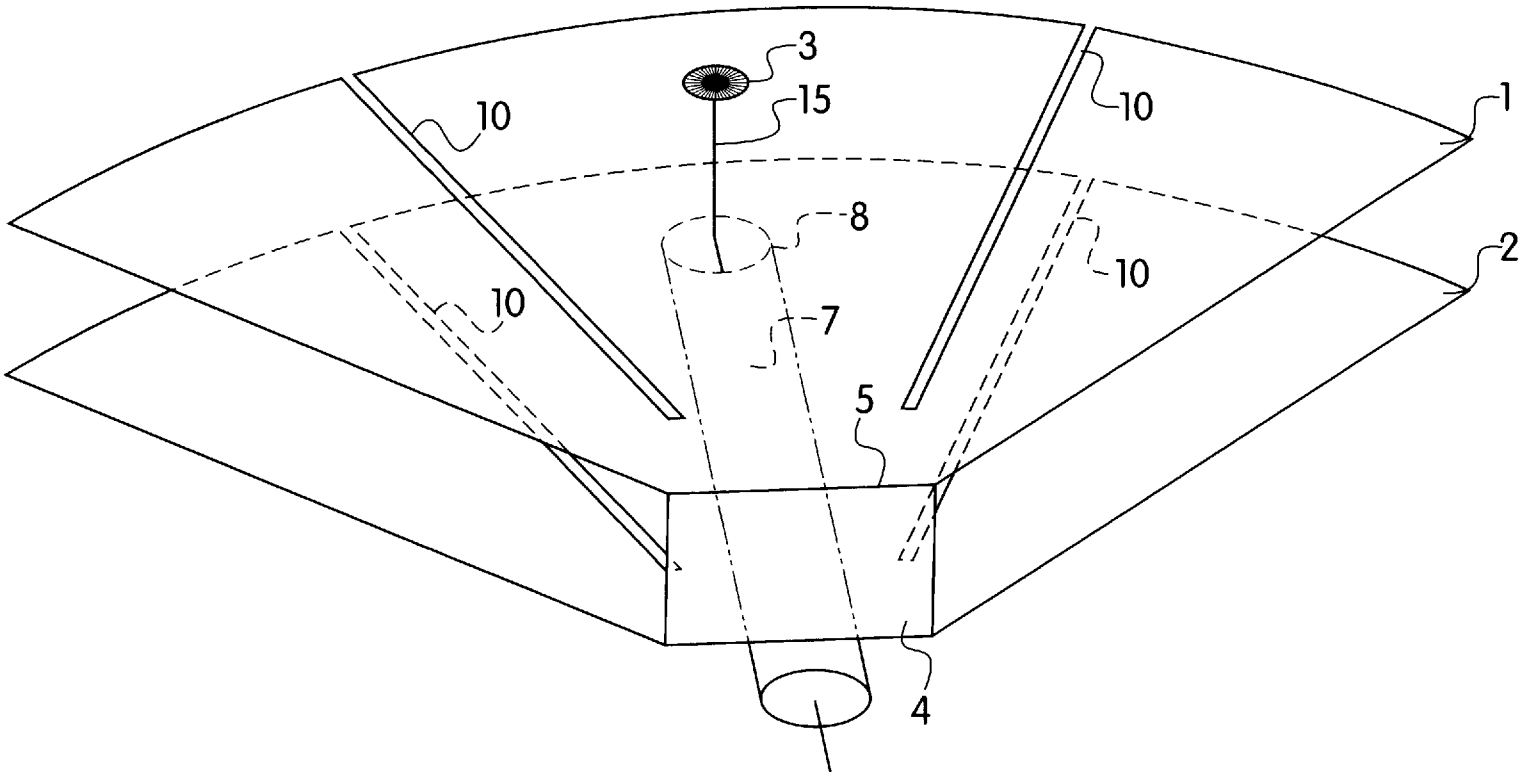
FIG. 6 shows a circular sector antenna with a second conductive area shaped in the same way, and mounting of the coaxial line of the antenna parallel with said area.

An antenna according to the invention can be designed also, for example as shown in FIG. 6, with the conductive areas 1 and 2 congruent relative to one another. In the present case the outer jacket of the coaxial line 7 extends parallel with the surface 2, so that it does not interfere with the electrical field perpendicular to the areas 1, 2.

What is claimed is:

1. A substantially flat antenna preferably for frequencies in the Ghz-range, comprising:

a first electrically conductive area that is not greater than ⅜ of a wavelength, and having at least one slot with an open end pointing at an edge of said conductive area, said at least one slot defining the flow of current in said electrically conductive area so that when the antenna receives a signal in a first and in each additional frequency range, the antenna has at least one resonance frequency in both the first, and in each additional frequency range;

a second electrically conductive area being at least the same size as said first electrically conductive area, wherein said second conductive area acts as a ground shield to said first conductor, wherein said second conductive area is arranged parallel and opposite to said first conductive area;

a conductive bridge connecting a conductive edge of the first conductive area across its width to said second electrically conductive area, said conductive bridge connecting said first conductive area to said second conductive area with low resistance; and, a coaxial line having an inner conductor and an outer conductor wherein said inner conductor is connected through a coupling point to said first electrically conductive area and said outer conductor is connected to said second electrically conductive area.

2. The antenna according to claim 1, wherein said first electrically conductive area has two marginal zones, and one inner zone, said marginal zones being separated by said at least one slot, and having lengths that are selected so that they only slightly impair the flow of the current in the areas of the first frequency range, wherein the entire conductive area serves as the active zone for the formation of resonant frequencies.

3. The antenna according to claim 1, wherein said bridge has at least one slot, having a length selected so that it only slightly impairs the flow of the current in the areas in the first frequency range, wherein the total width of the bridge provides an inductive effect to form resonant frequencies, wherein the flow of current on said bridge is determined for each additional frequency range so that the effective width appears smaller than the active width.

4. The antenna according to claim 1, wherein said at least one slot in said first electrically conductive area is formed to have a length of ¼ wavelength, so that it has a high impedance at its open end located on the edge of the conductive area.

5. The antenna according to claim 1, wherein said first electrically conductive area further comprises at least one recessed portion positioned so that an edge of said recessed portion forms a closed edge to said slot, wherein the area of the recessed portion is larger than the area of the slot, so that the slot has a high impedance in the second frequency range, and the lowest possible impedance in the first frequency range.

6. The antenna according to claim 1, wherein said first electrically conductive area is rectangular shaped, and said coupling point is located on a central line bisecting said area and perpendicularly intersecting said connecting edge.

7. The antenna according to claim 1, wherein said first electrically conductive area has a substantially circular shape having a circular center bore, and wherein said coupling point is located along a central axis line that bisects said connecting edge.

8. The antenna according to claim 1, wherein said first electrically conductive area is fan shaped, and extends out at an angle less than 180 degrees, wherein said coupling point is located along a central axis line that bisects said connecting edge.

9. The antenna according to claim 8, further comprising substantially linear slots extending from an outer edge of said fan shaped area towards a central axis bisecting said zone, said slots ending in said inner zone.

10. The antenna according to claim 9, wherein said linear slots are located on said first zone, said slots arranged symmetrically relative to a central axis bisecting said zone, wherein said slots are arranged so that they form active inner zones that are adjusted for D and E networks, and for satellite-supported navigation GPS.

11. The antenna according to claim 1, wherein the first electrically conductive area contains at least two symmetrically designed slots positioned opposite each other relative to a central line that bisects said area, said slots extending in from an outer edge on said conductive area to said inner zone.

12. The antenna according to claim 11, wherein said slots fan away from said central line to the outer edges of said zone.

13. The antenna according to claim 1, comprising at least two slots each having different lengths.

14. The antenna according to claim 1, wherein said second conductive area is a substantially horizontal surface relative to an automobile body.

15. The antenna as claimed in claim 14, wherein said first area is mounted on a non-conductive surface on a vehicle body.

16. The antenna according to claim 1, wherein said first and said second conductive areas are substantially congruent with each other, and said conductive line extends substantially parallel to said second conductive area, so that it does not interfere with an electrical field perpendicular to said first and said second areas.

* * * * *